US007780547B2

(12) United States Patent
Ban

(10) Patent No.: US 7,780,547 B2
(45) Date of Patent: Aug. 24, 2010

(54) GOLF CLUB HEAD

(75) Inventor: Wataru Ban, Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 11/640,284

(22) Filed: Dec. 18, 2006

(65) Prior Publication Data

US 2007/0142124 A1 Jun. 21, 2007

(30) Foreign Application Priority Data

Dec. 16, 2005 (JP) ..... 2005-363560

(51) Int. Cl.
*A63B 53/04* (2006.01)

(52) U.S. Cl. ..... 473/324; 473/345

(58) Field of Classification Search ..... 473/345, 473/324

See application file for complete search history.

(56) References Cited

U.S. PATENT DOCUMENTS

| | | | | |
|---|---|---|---|---|
| 4,725,512 | A * | 2/1988 | Scruggs | 428/678 |
| 5,743,812 | A * | 4/1998 | Card | 473/327 |
| 5,851,158 | A * | 12/1998 | Winrow et al. | 473/330 |
| 6,428,427 | B1 * | 8/2002 | Kosmatka | 473/349 |
| 6,723,007 | B1 * | 4/2004 | Chao | 473/342 |
| 6,899,638 | B2 * | 5/2005 | Iwata et al. | 473/329 |
| 7,597,966 | B2 * | 10/2009 | Spitsberg et al. | 428/469 |
| 2002/0019265 | A1 * | 2/2002 | Allen | 473/329 |
| 2003/0083147 | A1 * | 5/2003 | Sano | 473/324 |
| 2005/0282655 | A1 * | 12/2005 | Sasaki | 473/324 |

FOREIGN PATENT DOCUMENTS

| | | | |
|---|---|---|---|
| JP | 9-182818 | * | 7/1997 |
| JP | 2000-72984 | A | 3/2000 |
| JP | 2003-310805 | A | 11/2003 |
| JP | 2005-270518 | A | 10/2005 |

* cited by examiner

*Primary Examiner*—Stephen L. Blau
(74) *Attorney, Agent, or Firm*—Sughrue Mion, PLLC

(57) ABSTRACT

A golf club head of a hollow wood type, that includes: a face portion; a body portion including a crown portion; and a film provided on the face portion and at least a front part of the crown portion. A film thickness $T_1$ of the face portion is greater than or equal to a film thickness $T_2$ of the body portion.

10 Claims, 4 Drawing Sheets

GOLF CLUB HEAD

BACKGROUND OF THE INVENTION

1. Field of the Invention

The present invention relates to a golf club head of a hollow wood type, and particularly to a golf club head having a film.

2. Description of the Related Art

It is well known that the golf club head of hollow wood type is provided with a film (e.g., refer to JP-A-2005-270518, JP-A-2000-72984 and JP-A-2003-310805).

The film is provided on the face portion alone, or the film is provided over the entire gold club head, as disclosed in JP-A-2005-270518. A plurality of film layers are provided as disclosed in JP-A-2000-72984 and JP-A-2003-310805.

SUMMARY OF THE INVENTION

Generally, as the film thickness is greater, the film is more excellent in the wear resistance, but the film crack is more likely to occur. Conversely, if the film thickness is smaller, the film is lower in the wear resistance, but strong against the film crack.

An object of the invention is to provide a golf club head with a film in which the film of the face portion is excellent in the wear resistance and the film crack of the body portion is prevented.

An aspect of the invention provides a golf club head of a hollow wood type, comprising: a face portion; a body portion including a crown portion; and a film provided on the face portion and at least a front part of the crown portion, wherein a film thickness $T_1$ of the face portion is greater than or equal to a film thickness $T_2$ of the body portion.

Preferably, $T_1$ is from 100 to 200 μm, and $T_2$ is from 30 to 100% of $T_1$.

Preferably, the film is composed of at least two layers, and the hardness of a film layer of the outermost layer is higher than the hardness of any other film layer.

Preferably, the film of the face portion is urethane base, and the film of the body portion is polyester base.

According to the golf club head, since the film thickness $T_1$ of the face portion is greater than the film thickness $T_2$ of the body portion, the film of the body portion has excellent wear resistance. Also, the film crack of the film on the body portion such as the crown portion is suppressed. The film weight is suppressed by reducing the film thickness of the body portion.

DETAILED DESCRIPTION OF THE PREFERRED EMBODIMENTS

Figure 1:
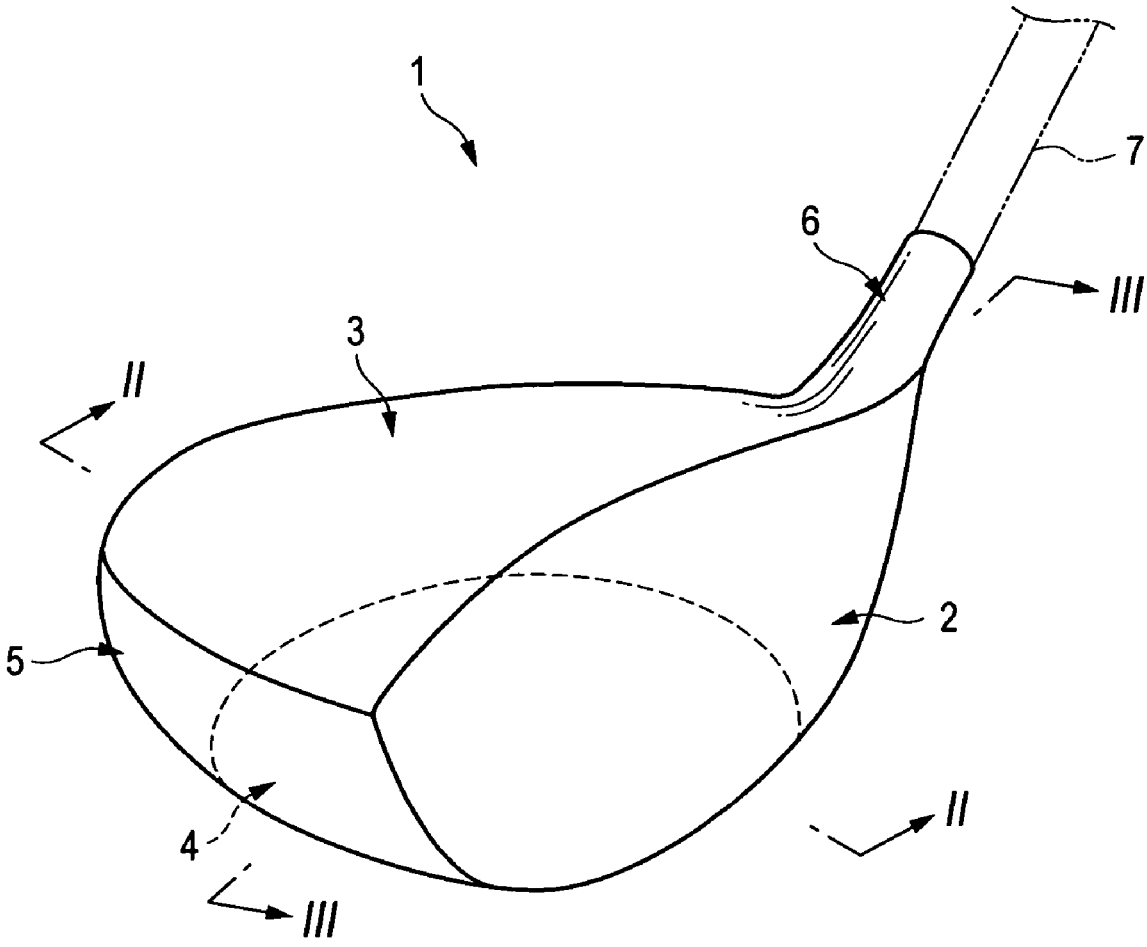
FIG. 1 is a perspective view of a golf club head according to an embodiment of the present invention.
Figure 2:
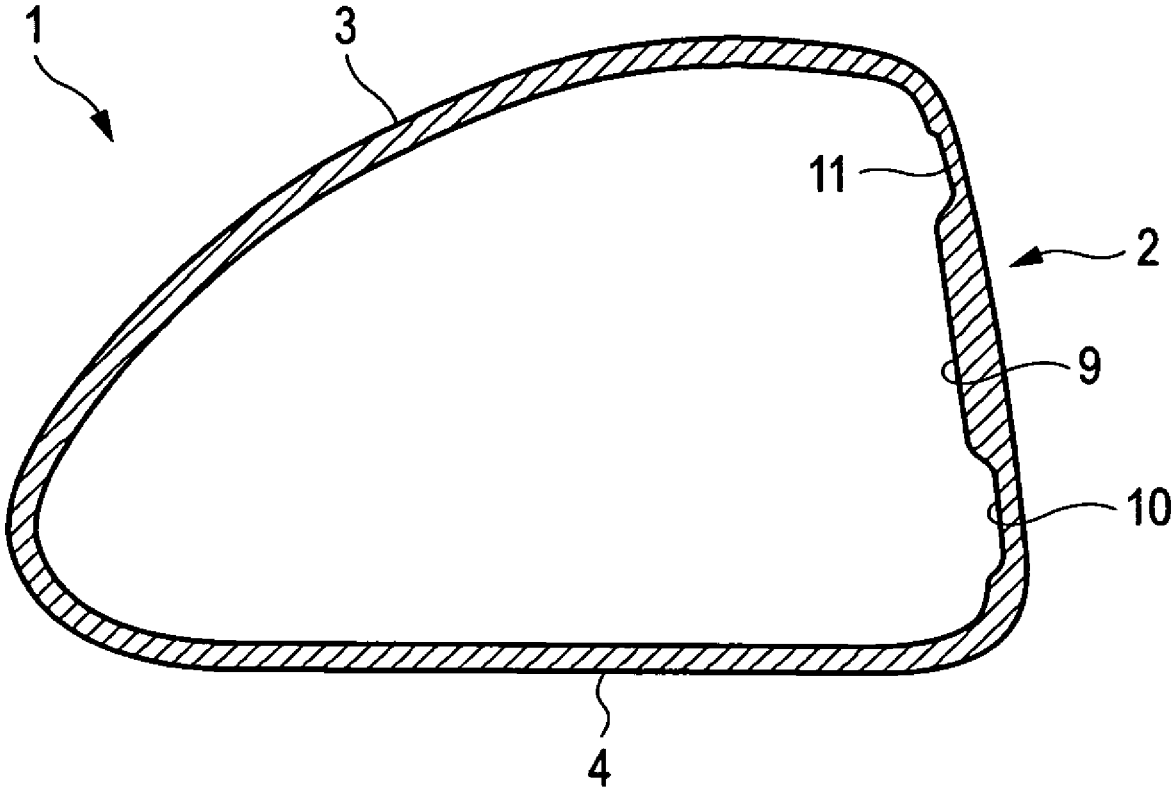
FIG. 2 is a cross-sectional view taken along the line II-II of FIG. 1.
Figure 3:
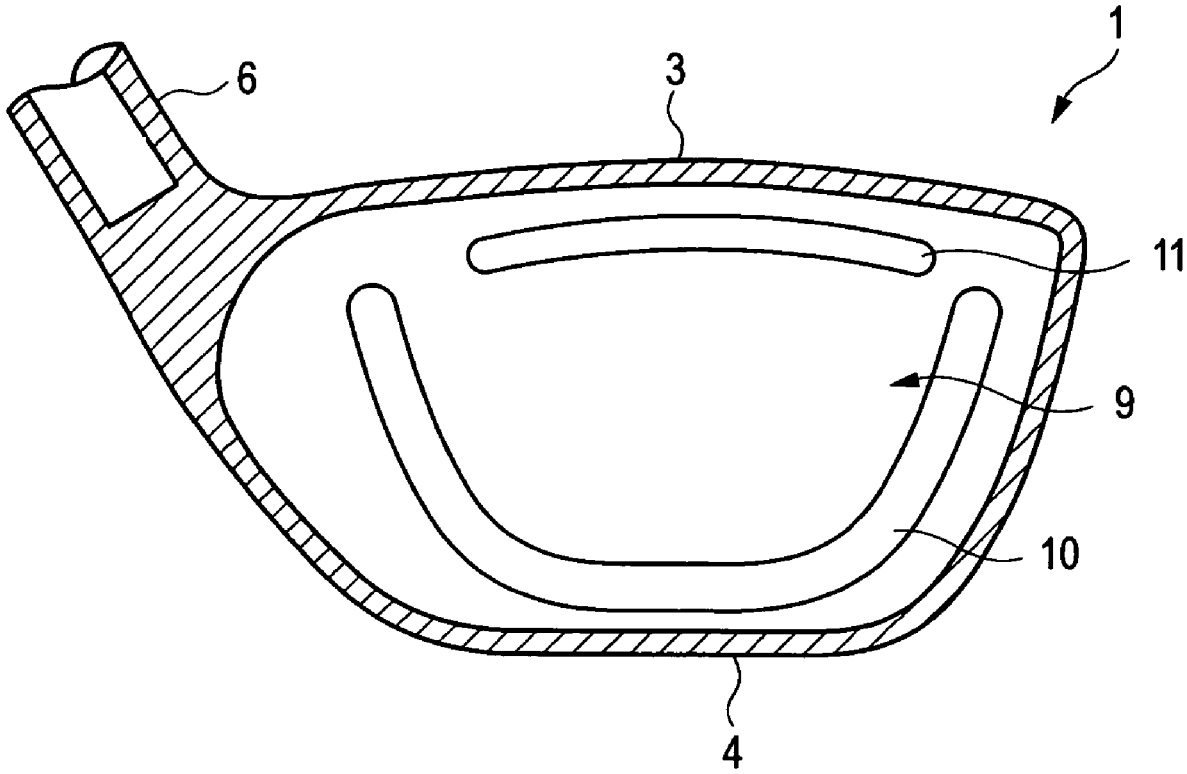
FIG. 3 is a cross-sectional view taken along the line III-III of FIG. 1.

Embodiments of the present invention will be described below with reference to the drawings. FIG. 1 is a perspective view of a golf club head 1 according to an embodiment of the invention. FIG. 2 is a cross-sectional view taken along the line II-II of FIG. 1. FIG. 3 is a cross-sectional view taken along the line III-III of FIG. 1.

The golf club head 1 made of metal and having a hollow portion comprises a face portion 2, a crown portion 3, a sole portion 4, aside portion 5 and a hosel portion 6. A shaft 7 is inserted into the hosel portion 6 and secured by adhesives to make up a golf club.

In this embodiment, a thickened portion 9 having a larger thickness is provided in the central part of the back of the face portion 2, and the thinner portions 10, 11 having a smaller thickness are provided around the thickened portion. A thinner portion 11 on the upper side of this thickened portion 9 extends in the width direction of the face portion 2.

A thinner portion 10 extends like a U-shape to turn around both sides and the lower side of the thickened portion 9.

The thickened portion 9 preferably extends 23 mm or more vertically. The length of 23 mm is derived from the diameter of a golf ball. The horizontal width of the thickened portion 9 is preferably greater than the vertical width of the thickened portion 9, particularly from about 2.0 to 5.0 times. This is because the face shape of the golf club head is generally larger in the horizontal width than the vertical width.

The distance from the edge on the periphery of the thickened portion 9 vertically and horizontally to the peripheral part of the face portion 2 is preferably from about 10 to 18 mm vertically on the upper side of the thickened portion 9, from about 3 to 18 mm vertically on the lower side of the thickened portion 9, preferably from about 10 to 20 mm horizontally on the toe side of the thickened portion 9, and preferably from about 10 to 20 mm horizontally on the heel side of the thickened portion 9.

The thickness of the thickened portion 9 may be uniform, or may be larger stepwise or continuously to the center of the thickened portion 9. The thickness of the thickened portion 9 (average thickness in the case of the thickened portion having uneven thickness) is preferably 1.4 to 4.0 times the thickness of the thinner portion 10, 11, particularly 1.5 to 3.0 times. If the material of the golf club head is titanium alloy, whose Young's modulus is 7500 to 11000 kgf/mm$^2$ (73.5 to 107.8 GPa), the thickness of the thickened portion 9 is preferably from about 2.2 to 3.5 mm. If the thickness is too large, the center of gravity of the golf club head is shallower, the backspin amount is decreased, and the hit ball is less likely to rise. The thickness of the thinner portion 10, 11 is preferably about 1.8 to 2.2 mm for the alloy having the above Young's modulus.

On this golf club head 1, the film (not shown) is provided on the face portion 2, the crown portion 3, and the side portion 5. The sole portion 4 may or may not be provided with the film.

The film thickness $T_1$ of the face portion 2 is greater than the film thickness $T_2$ of the other body portion (crown portion 3 and side portion 5). Preferably, $T_1$ is from 100 to 200 μm, particularly from 120 to 180 μm, and $T_2$ is from 30 to 100% of T1, particularly from 50 to 100%.

The film of the face portion 2 is suitably urethane film, particularly two liquid curable urethane film. The film of the body portion is suitably polyester film, particularly thermally curable polyester film. The film of the body portion may be acrylic, epoxy or vinyl chloride.

The urethane film having a large film thickness on the face portion 2 is excellent in the wear resistance. Also, the film of polyester having a small film thickness on the body portion unlikely to crack. The two liquid curable urethane film is cheap and easy to coat thickly. The thermally curable polyester film has a low viscosity when applying and is easy to coat thinly and uniformly.

Figure 4:
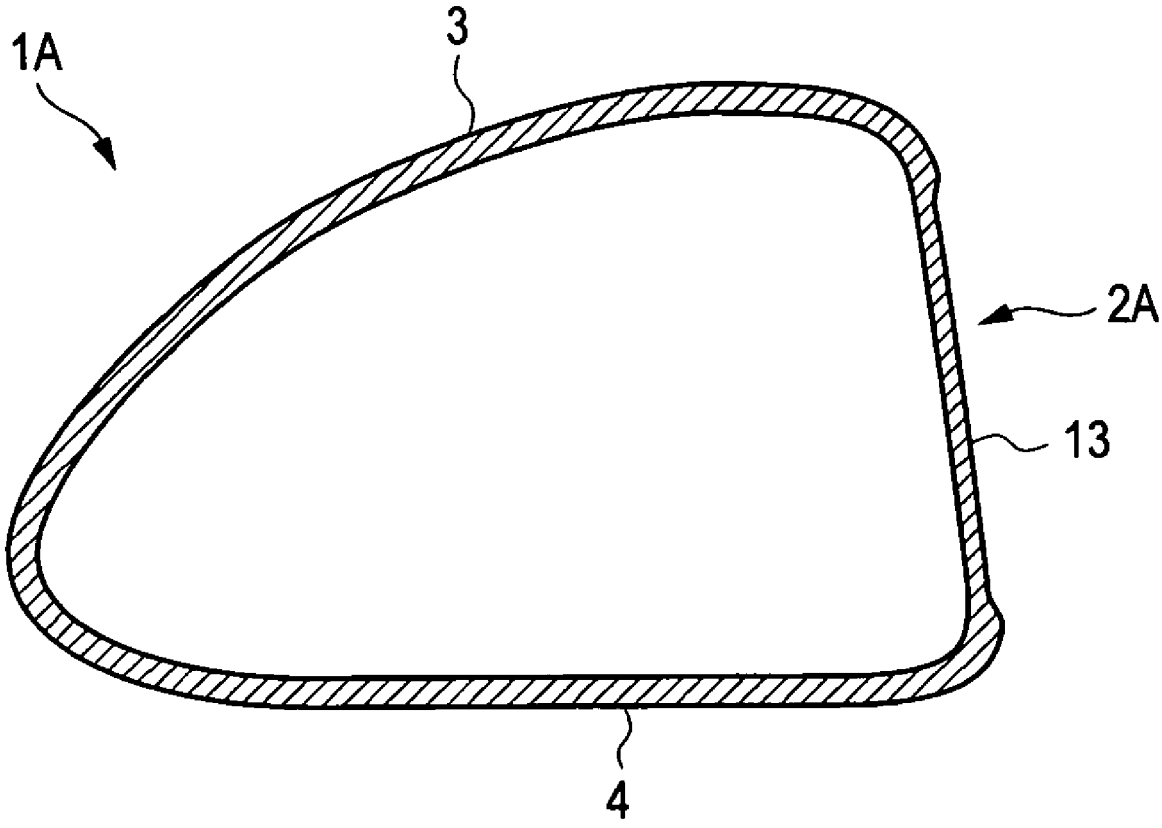
FIG. 4 is a cross-sectional view of a golf club head according to another embodiment of the invention.

Though the thinner portions 10, 11 are provided by depressions on the back of the face portion 2 in FIGS. 1 to 3, the thinner portion 13 may be provided on the front side of the face portion 2 by providing a depression near the central part of the front surface of the face portion 2, like the golf club head 1A shown in FIG. 4. In this way, if the thinner portion 13 like a concave is provided on the front surface of the face portion 2, it is easy to form the film having a large film thickness by coating the paint on the thinner portion 13 thickly.

Though the film of the body portion may be provided on only the former half part of the crown portion 3, it is preferred that the film is provided over the entire surface of the crown portion 3 and the side portion 5 as in the above embodiment to be more pleasing in appearance.

The film may have one layer, but preferably two or more layers. Particularly, it is preferred that the film layer having a high hardness as the film of the superficial layer is provided to prevent the flaw.

The invention is applicable to a driver, a fairway wood, and other utility clubs approximate to them.

Examples

The films having thickness as shown in Table 1 were formed by coating multiply the polyester based paint on the entire outer surface of a hollow driver made of titanium alloy and having a volume of 350 cc. A driver was produced by attaching this golf club head to a shaft having a length of 44 inches. For this driver, the face strength, the hitting sense and the film strength were evaluated as follows.

The face strength was measured by confirming a part where a face metal surface appeared because the coat was peeled with a microscope. The metal surface was relatively evaluated based on whether or not there was a flaw or the size of a flaw.

The hitting sense is the sensual assessment in which ten subjects actually hit the ball and are relatively evaluated. The results are expressed with "o" and "x" while taking the average of ten persons.

The film strength was obtained employing the unclean ball before washing, with 100 shots×10 persons actually hit outdoors, whereby the extent of peeled coat was relatively evaluated.

The results are shown in Table 1.

TABLE 1

| | Example 1 | Example 2 | Example 3 | Example 4 | Example 5 | Comparative example 1 | Comparative example 2 |
|---|---|---|---|---|---|---|---|
| Face film thickness | 60 μm | 60 μm | 120 μm | 120 μm | 180 μm | 240 μm | 0 μm |
| Body film thickness | 60 μm | 120 μm | 60 μm | 120 μm | 60 μm | 60 μm | 60 μm |
| Face strength | ○ | ○ | ○ | ○ | ○ | x | x |
| Hitting sense (softness) | x | x | ○ | ○ | ○○ | ○○ | x |
| Film strength | ○○ | ○○ | ○ | ○ | Δ | x | — |
| Integrated evaluation | ○ | ○ | ○○ | ○○ | ○ | Δ | x |

○○: Very good,
○: good,
x: No good,
Δ: neither good nor bad

As shown in Table 1, the film thickness $T_1$ was made from 100 to 200 μm, and $T_2$ was made from 30 to 100% of T1, as in the examples 3 to 5, whereby the hitting sense and the film strength were balanced and the excellent results were obtained.

What is claimed is:

1. A golf club head of a hollow wood type, comprising:

a face member;

a body member including a crown portion, the body member and the crown portion formed of metal; and a first film provided on the face member and a second film provided on at least a front part of the crown portion, wherein a thickness $T_1$ of the first film is greater than a thickness $T_2$ of the second film, wherein the second film extends from the metal of the crown portion to an outside surface of the golf club head, wherein the first film is composed of at least two layers, and a hardness of the outermost layer is higher than a hardness of any other layer.

2. The golf club head according to claim 1, wherein $T_1$ is from 100 to 200 μm, and $T_2$ is at least 30% of $T_1$.

3. The golf club head according to claim 1, wherein the first film is urethane base, and the second film is polyester base.

4. The golf club head according to claim 1, wherein a thinner portion is provided on the front side of the face member by providing a depression near a central part of a front surface of the face member.

5. The golf club head according to claim 1, wherein a depression is provided on a back side of the face member so as to surround a central part of the face member.

6. The golf club head according to claim 1, wherein a U-shaped thinner portion and a liner-shaped thinner portion are provided on a back side of the face member so as to surround a central part of the face member, wherein the U-shaped thinner portion does not contact the liner-shaped thinner portion.

7. The golf club head according to claim 1, wherein the Young's modulus of the golf club head is 7500 to 11,000 $kgf/mm^2$.

8. The golf club head according to claim 1, wherein the golf club head is made of a titanium alloy.

9. The golf club head according to claim 1, wherein the second film is comprised of polyester film.

10. The golf club head according to claim 1, wherein the second film is provided without a sole portion.

* * * * *